United States Patent [19]

Hegg

[11] 4,426,164

[45] Jan. 17, 1984

[54] LINE SPACER FOR METAL STAMPING DEVICES

[75] Inventor: Hendrick C. Hegg, Hoffman Estates, Ill.

[73] Assignee: Imperial Stamp & Engraving Co., Mt. Prospect, Ill.

[21] Appl. No.: 383,503

[22] Filed: Jun. 1, 1982

[51] Int. Cl.[3] ..... B41J 3/28

[52] U.S. Cl. ..... 400/46; 400/532; 400/44; 400/23

[58] Field of Search ..... 400/23, 44–47, 400/127, 129, 134, 134.1, 134.2, 134.3, 134.6, 531, 532

[56] References Cited

U.S. PATENT DOCUMENTS 1,073,573 9/1913 Walter ..... 400/46

*Primary Examiner*—Edgar S. Burr
*Assistant Examiner*—David A. Wiecking
*Attorney, Agent, or Firm*—Edward C. Threedy

[57] ABSTRACT

An adjustable gearless line spacer for use with metal stamping typewriter apparatuses where it is desirous to uniformly space each line of type through a simple lever actuation, and to be able to conveniently adjust and preset the spacing between lines of type.

8 Claims, 11 Drawing Figures

LINE SPACER FOR METAL STAMPING DEVICES

SUMMARY OF THE INVENTION

It is an object of the present invention to provide an assembly which may be readily attached to an existing structure, such as a metal marking machine of the typewriting type, whereby line spacing can be adjusted and preset and easily achieved.

The present line spacing mechanisms as used on metal marking machines and the like utilize a gear and rack assembly for obtaining line spacing movement. The operator must take care to determine the exact amount of actuation of a rotatable gear wheel to achieve uniform spacing between a line of type.

In metal marking machines there is normally provided a table support upon which is independently positioned a work piece supporting platen. It is necessary to move the platen independently over the table support to establish line spacing between lines of marking performed by the machine. The present invention achieves the desired line spacing through the simple actuation of a single pivotal lever. The degree of pivotal movement of the lever can be determined by a preset adjustable intercepting surface.

The invention includes a slidable housing which supports the platen in a position upon the table support. The housing is journalled on a guide rod and includes a spring biased latching mechanism that prevents free slidable movement of the housing along its guide rod. The latching assembly may, through the actuation of a single lever, form the basis against which the housing is moved in a limited manner in one direction over its guide rod. An actuation of a release lever will permit the manual movement of the housing in an opposite direction over the complete length of the guide rod.

The invention includes a relatively few parts, all of which are simple in construction and operation, and which may be economically manufactured and assembled. The unit can be readily used to replace the existing line spacer on metal marking machines.

GENERAL DESCRIPTION OF THE DRAWINGS

The invention will be best understood by reference to the accompanying drawings, which show the preferred form of the invention by which the stated objects thereof are achieved, and, in which.

GENERAL DESCRIPTION OF THE INVENTION

Figure 1:
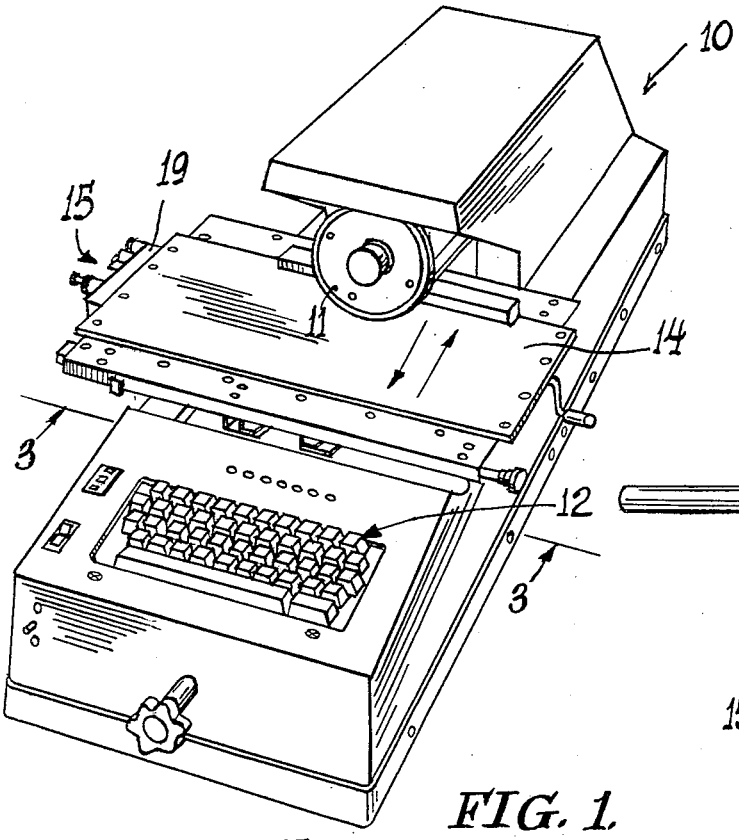
FIG. 1 is a perspective view of a metal stamping device to which the line spacer is applicable.
Figure 2:
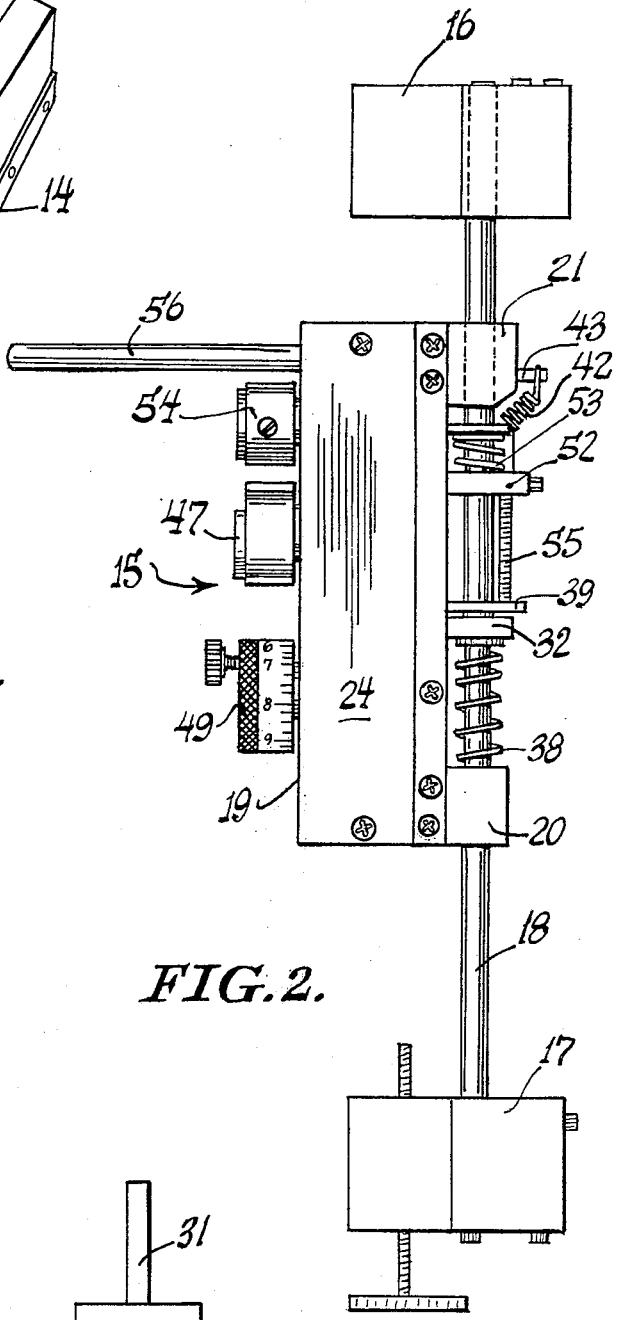
FIG. 2 is a top plan view of the line spacer of the invention.

The line spacer assembly of this invention is adapted to be associated with a metal marking machine 10, such as is shown in FIG. 1.

The metal marking machine consists of a marking wheel 11 which is adapted to be actuated by a selective key switch, the latter being a part of a keyboard assembly 12. The metal marking machine includes a support table 13 which, except for a vertical movement during printing operation, is stationary and which in turn supports a work piece supporting slide table or platen 14.

The line spacer assembly 15 is interrelated to the slide table 14, and permits transverse movement of the slide table over the table support.

Figures 3, 4, 5:
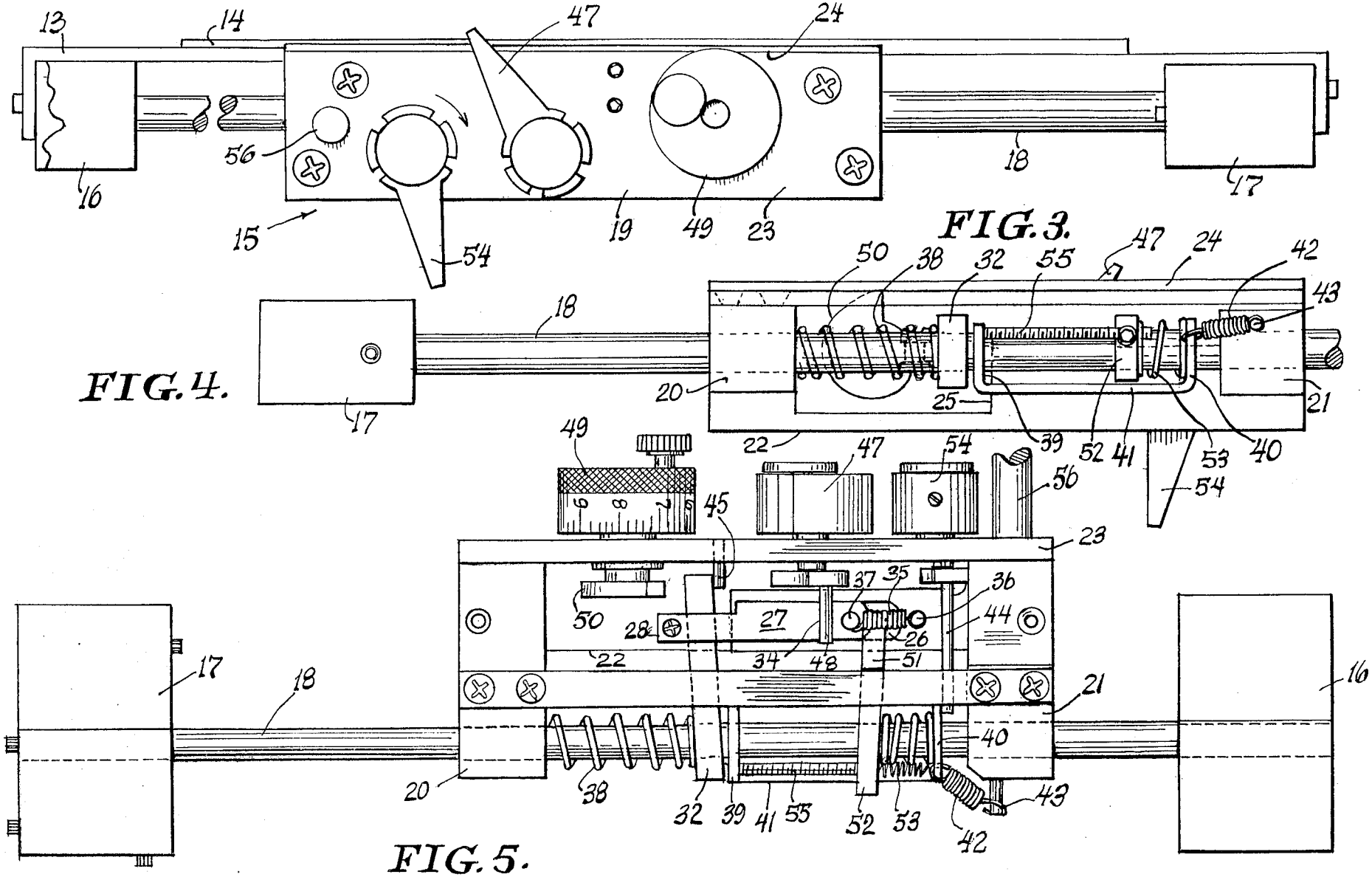
FIG. 3 is a side elevational view of the line spacer of this invention.
FIG. 4 is the opposite side plan view of the line spacer of this invention.
FIG. 5 is a top plan view of the invention with the top cover removed.

The line spacer assembly consists of two end blocks 16 and 17 which are adapted to be fixedly connected to the support table in the manner shown in FIG. 3. Extending between the fixed end blocks is a spacer rod 18 that movably supports the spacer assembly.

The assembly includes a housing 19 which is attached to one edge 20 (see FIG. 1) of the slide table 14 as it is situated upon the table support 13 with the slide table 14 having transverse movement in a forward and backward direction as illustrated by the arrows.

The housing 19 consists of a pair of slide blocks 20 and 21 journalled on the stationary spacer rod 18. These slide blocks are connected together as an integral unit by a bottom wall 22, (see FIG. 4) a side wall 23, and a top cover plate 24 (see FIG. 3).

Supported by the bottom wall 22 and extending inwardly of the housing 19 from the slide block 21 is a partial pedestal 25 (see FIG. 4). As shown in FIG. 5, a recess 26 is cut in the top wall surface of the pedestal 25 and it slidably receives a spacing plunger 27. One end 28 of the spacing plunger extends from the recess 26 beyond the end wall of the pedestal 25 and is bifurcated to provide spaced legs 29 and 30, (see FIG. 9) so as to receive therebetween the tail portion 31 of a lock block 32 journalled upon the guide rod 18.

Figure 8:
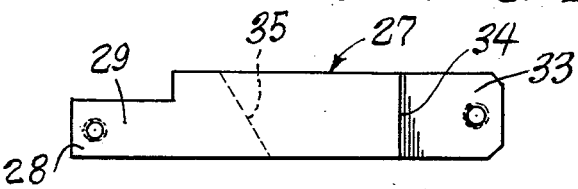
FIG. 8 is a top plan view of the spacing plunger as employed in this invention.
Figure 9:
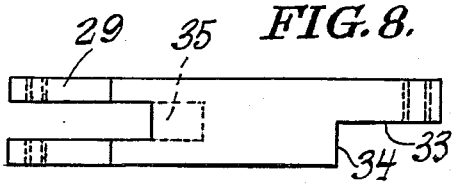
FIG. 9 is a side elevational view of the spacing plunger.

As shown in FIGS. 8 and 9, the opposite end of the spacing plunger is relieved, as at 33, so as to provide a shoulder 34, the purpose and function of which will be hereinafter explained. Also, as shown, the base between the spaced legs 29 and 30 is angularly cut, as at 35.

The spacing plunger 27 is slidably maintained within the recess 26 by an expansion spring 35 which extends between a fixed stud 26 mounted on the top surface of the partial pedestal 25, and a like stud 37 mounted adjacent the end of the relieved portion of the spacing plunger 27. Coiled about the spacer rod 18 and disposed between the slide block 20 and the journalled portion of the lock block 32 is an expansion spring 38. This spring 38 normally urges the lock block 32 away from the slide block 20.

Also journalled on the spacer rod 18 are the spaced parallel arms 39 and 40 of a U-shaped release bracket 41 (see FIG. 4). As shown, one upper free corner of the arm 40 has connected thereto one end of a coil spring 42 with the opposite end of the spring connected to a stud 43 projecting out of the slide block 21.

This spring releasably maintains the bracket 41 in the position shown in FIGS. 2, 4, 5, and 6, wherein the arm 40 is in contact with an actuation lever 44.

The tail portion 31 of the lock block 32 in its normal position is in contact with an arresting pin 45. The arrangement being such that the expansion of the spring 38 against the journalled portion of the lock block 32 will cause it to be cantered or placed at a slight angle with respect to the spacer rod 18 such that it binds thereon and resists free movement of the rod 18 therethrough.

In order for the housing 19 to move over the spacer rod 18 the circular openings formed in the end blocks 20 and 21 as well as the opening 46 formed in the lock block 32, through which the rod 18 is journalled, all must be in axial alignment. The cantering of the lock block 32 disposes its circular opening 46 slightly out of axial alignment, and therefore, it prevents movement of the spacer rod 18 therethrough. It is through this resistance that movement of the housing 19 and the slide table 14 along the spacer rod 18 and over the support table 13 is achieved.

Pivotally mounted on the side wall 23 of the housing 19 is a spacing lever 47 which in turn has associated therewith a spacing arm 48 which is in contact with the shoulder 34 formed on the spacing plunger 27. When the lever 47 is pivoted in the direction of the arrow (FIGS. 3 and 6), it will cause the spacing arm 48 to engage the shoulder 34 and exert pressure upon the spacing plunger 27, which in turn will exert pressure upon the lock block 32. However, as the lock block 32 is in its cantered position it cannot move relative to the spacer rod 18.

Figure 6:
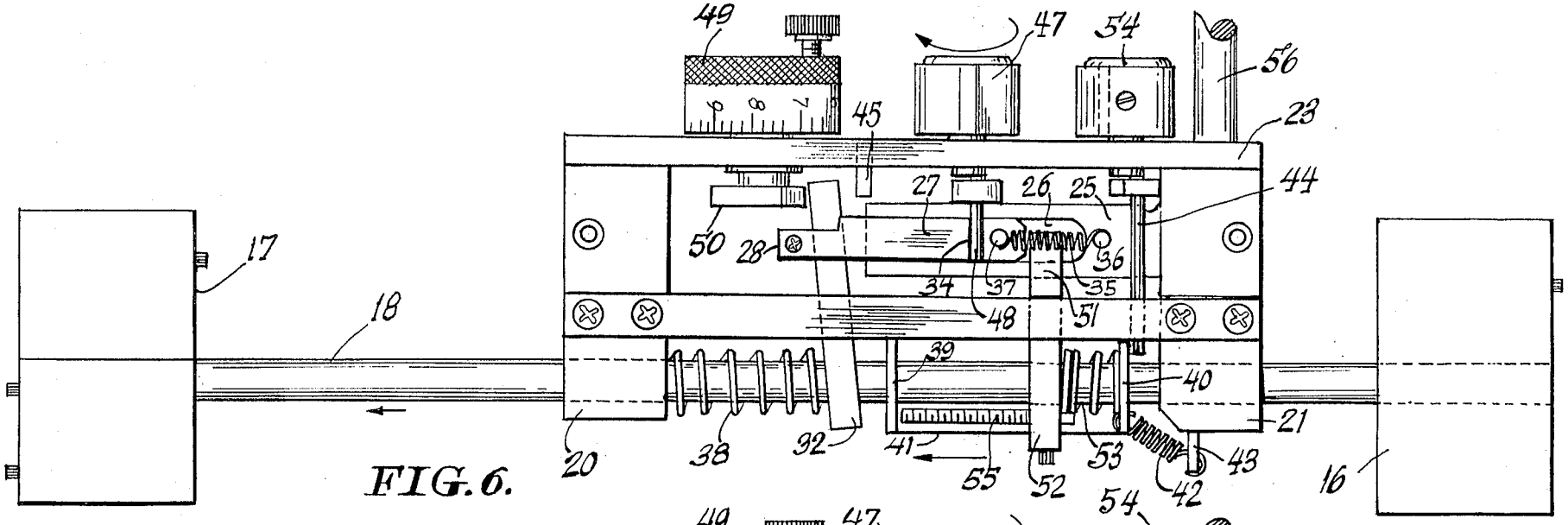
FIG. 6 is a top plan view of the invention in an advancement step position.

In its restrained position the lock block 32 acts as a base, and in a reaction to the movement of the spacing lever 47 the housing 19 will be forced to move on the stationary spacer rod 18 in the direction of the arrow shown in FIG. 6. This movement will also cause the slide table 14 to move over the support table 13 and beneath the marking wheel 11. The spacing plunger 27 maintains the lock block 32 in its cantered position with respect to the stationary spacer rod 18 in the same manner as did the arresting pin 45.

The degree of movement of the housing 19 along the stationary spacer rod 18 is dependent upon the setting of the spacing wheel 49.

Figure 10:
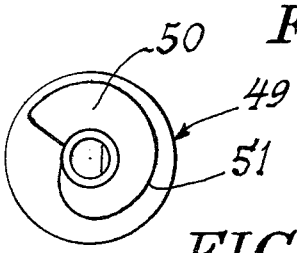
FIG. 10 is a plan view of the control face of the spacing knob.
Figure 11:
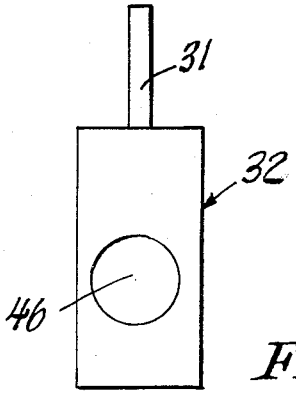
FIG. 11 is a plan view of the locking element of this invention.

As shown in the drawings, this wheel 49 is mounted on the side wall 23 of the housing 19 and has at its inner end a cam disk 50. As shown in FIG. 10, the peripheral edge 51 of the cam 50 varies in radius from the center of the wheel 49. When the movement of the housing 19 over the stationary spacer rod 18 is such that it brings the peripheral edge 51 of the cam 50 into engagement with the tail portion 31 of the lock block 32, further movement of the housing 19 is arrested. It should, therefore, be noted that the distance of travel of the housing 19 will be determined by the setting of the peripheral edge 51 of the cam 50 by rotation of the selector knob 49 relative to the tail portion 31 of the lock block 32.

When the spacing lever 47 is released the spacing plunger 27 will be drawn back to its original position by spring 35. This will permit the lock block 32 to assume a perpendicular relation to the stationary spacer rod 18 and under the expansion of the spring 38 it will be moved over the spacer rod 18 until the tail portion 31 of the lock block 32 once again engages the arresting pin 45, at which time the lock block 32 will again be cantered with respect to the stationary spacer rod 18 so that its center opening 46 binds upon the rod 18 to lock the same against further movement in that one direction.

To prevent any unwanted retracting movement of the housing 19 over the stationary spacer rod 18 during the period of time when the expansion spring 38 is moving the lock block 32 over the spacer rod 18 to its new latching position, there is provided a second locking element 52. As clearly shown in FIGS. 4 and 5, the locking element 52 has its head journalled on the stationary spacer rod 18 and its tail portion 51 projecting between the spring retaining studs 36 and 37. By a coil spring 35 journalled on the spacer rod 18 between the arm 40 of the U-shaped release bracket 41 and the head of the lock element 52 the same will assume a cantered or angular position relative to the spacer rod 18. It should be noted that the angular displacement of the lock element 52 is in direct opposite to that of the lock block 32 when both are in their normal rest position. In such an angular position the lock element 52 will freely permit movement between itself and the spacer rod 18 in the direction of the arrow, as shown in FIG. 6, yet restrict movement in an opposite direction.

After a completed spacing operation, continuing through a series of step-by-step actuation of the spacing lever 47, it is desirous to obtain the complete and full return of the slide table 14 to its original position. This is achieved by a release of the lock block 32 from the rod 18 and a manual return of the spacer assembly to its original position.

Figure 7:
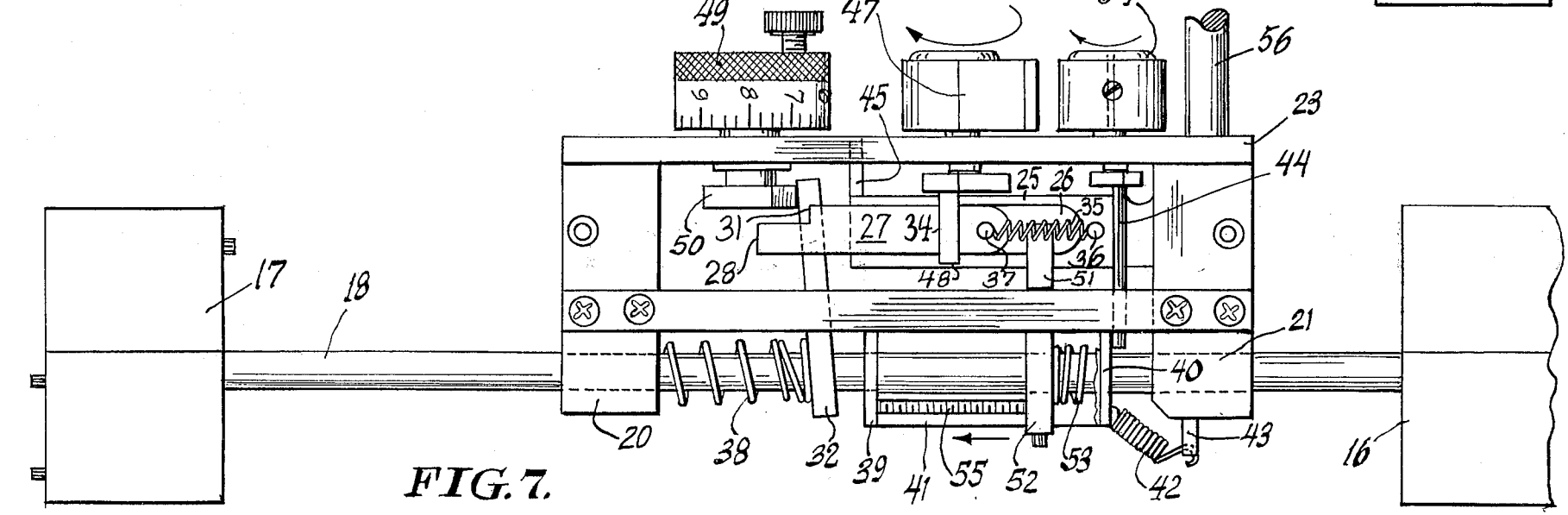
FIG. 7 is a top plan view of a release position of the invention.

To achieve the free release of the spacing assembly 15 from the spacing rod 18, the operator will rotate the release lever 54 in the direction of the arrow, as shown in FIG. 7. The rotation of the release lever 54 will cause its actuation lever 44 to engage one of the arms 40 of the release bracket 41, which, in turn, will move the release bracket 41 from right to left, as shown in FIG. 7, against the action of its retaining spring 42. The movement of the release bracket 41 on the spacer rod 18 will move the journalled end of the lock block 32 in a like direction against the action of the coil spring 38. This movement will permit the arm 39 of the bracket 31 to contact and move so as to square the journalled end of the lock block 32 with respect to the rod 18, releasing the same from binding contact with the rod 18.

The operator will then be able to grasp the handle 56 and pull the same, together with the complete spacing assembly 15, into the direction of the stationary end block 17. This action is returning the assembly 15 will also return the slide table 14 to its original or start position relative to the machine to which it is associated.

While I have illustrated and described the preferred form of construction for carrying my invention into effect, this is capable of variation and modification without departing from the spirit of the invention. I, therefore, do not wish to be limited to the precise details of construction as set forth, but desire to avail myself of such variations and modifications as come within the scope of the appended claims.

Having thus described the invention, what I claim as new and desire to protect by Letters Patent is:

1. A line spacer for a typing or marking machine having a horizontally disposed work table carried by a spacing assembly that is adapted to be moved line by line with the spacing therebetween being adjustable, comprising:

(a) an elongated stationary means supporting a work table spacing assembly for movement thereover in either direction, (b) a work table spacing assembly freely journalled on said stationary means for movement thereover in either direction, (c) a locking member journalled on said stationary means and positioned at an acute angle thereto so as to have releasable holding attachment thereto and in contact with said spacing assembly for preventing free movement thereof in one direction along said stationary means, (d) a second locking element journalled on said stationary means and positioned thereon so as to have releasable holding attachment therewith for preventing movement of said spacing assembly along said stationary means is an opposite direction, (e) moving means carried by said assembly for contacting said locking member so as to move said spacing assembly away from said locking member a predetermined distance along said stationary means in said opposite direction, (f) means provided by said spacing assembly for contacting said second locking element for releasing the same from said stationary member as said assembly is moved away from said locking member in said opposite direction, (g) a manually operated means carried by said spacing assembly and movable therewith by said moving means for determining the length of movement of said moving means and said spacing assembly relative to said locking member for determining the line spacing of said spacing assembly, (h) means on said elongated stationary means and in contact with said locking member for moving the same over said stationary means a distance equal to the movement of said spacing assembly after each actuation of said moving means, and (i) a releasing means for said second locking element for permitting free movement of said spacing assembly over said stationary means in said opposite direction so as to return the work table to its original position with respect to either the typing or marking machine.

2. A line spacer as defined by claim 1 wherein said stationary means comprises a spacer rod fixedly connected to the machine and upon which is movably supported the work table spacing assembly.

3. A line spacer as defined by claim 1 wherein said moving means comprises a rotatable lever having an actuating arm in contact with and adapted to move a spacing plunger into contact with and away from said locking member so as to move said spacing assembly over said stationary means in a direction opposite to that of the pivotal movement of said plunger.

4. A line spacer as defined by claim 1 wherein said means for moving said locking member over said stationary means in one direction comprises an expansion spring coiled about said stationary means and yieldably bearing against said locking member so as to move the same over said stationary means in the direction of said assembly movement when said assembly is moved by said moving means over said stationary means.

5. A line spacer as defined by claim 1 wherein said locking member comprises an elongated member having an aperture at one end through which said stationary means is freely journalled with said latch member normally disposed in an actute angle to the long axis of said stationary means so as to cause said member to bind upon said stationary means as the same is journalled therethrough, and means provided by said assembly for maintaining said locking member in its angular relation with said stationary means so as to prevent movement of said spacing assembly relative to said stationary means in one direction.

6. A line spacer as defined by claim 2 wherein said moving means comprises a rotatable lever having an actuating arm in contact with and adapted to move a spacing plunger into contact with and away from said locking member so as to move said spacing assembly over said spacer rod in a direction opposite to that of the pivotal movement of said plunger.

7. A line spacer as defined by claim 2 wherein said means for moving said locking member over said spacer rod in one direction comprises an expansion spring coiled about said spacer rod and yieldably bearing against said locking member so as to move the same over said spacer rod in the direction of said assembly movement when said assembly is moved by said moving means over said spacer rod.

8. A line spacer as defined by claim 2 wherein said locking member comprises an elongated member having an aperture at one end through which said spacer rod is freely journalled with said locking member normally disposed in an acute angle to the long axis of said spacer rod so as to cause said member to bind upon said spacer rod as the same is journalled therethrough, and means provided by said assembly for maintaining said locking member in its angular relation with said spacer rod so as to prevent movement of said spacing assembly relative to said spacer rod in one direction.

* * * * *